United States Patent [19]

Cornelius

[11] 3,995,693

[45] Dec. 7, 1976

[54] RESERVOIR TREATMENT BY INJECTING MIXTURE OF $CO_2$ AND HYDROCARBON GAS

[75] Inventor: Archie J. Cornelius, Bartlesville, Okla.

[73] Assignee: Phillips Petroleum Company, Bartlesville, Okla.

[22] Filed: Jan. 20, 1976

[21] Appl. No.: 650,648

[52] U.S. Cl. ..... 166/268; 166/263

[51] Int. Cl.[2] ..... E21B 43/18

[58] Field of Search ..... 166/274, 273, 268, 305 R, 166/263, 266, 267

[56] References Cited

UNITED STATES PATENTS

| | | | |
|---|---|---|---|
| 2,623,596 | 12/1952 | Whorton et al. | 166/274 |
| 2,875,830 | 3/1959 | Martin | 166/274 X |
| 2,875,832 | 3/1959 | Martin | 166/275 X |
| 3,811,503 | 5/1974 | Burnett et al. | 166/274 X |
| 3,823,777 | 7/1974 | Allen et al. | 166/274 X |
| 3,871,451 | 3/1975 | Brown | 166/267 |

*Primary Examiner*—Stephen J. Novosad

[57] ABSTRACT

A process is provided in which hydrocarbon gas containing $CO_2$ is injected into an oil containing reservoir as an aid in recovering oil from the reservoir. Oil can be produced from at least one production well in said reservoir while hydrocarbon gas containing less $CO_2$ than the injected mixture of hydrocarbon gas and $CO_2$ can be recovered from production wells other than the oil producing well. Backflowing of the injection well produces a gas containing more $CO_2$ than the gas originally injected. The method provides an in situ separation of $CO_2$ from hydrocarbon gas.

12 Claims, No Drawings

RESERVOIR TREATMENT BY INJECTING MIXTURE OF $CO_2$ AND HYDROCARBON GAS

BACKGROUND OF THE INVENTION

This invention relates to the treatment of underground oil reservoirs. In one of its aspects this invention relates to the recovery of oil from a reservoir by treatment with a mixture of hydrocarbon gas and carbon dioxide. In another of its aspects this invention relates to a method for reducing the $CO_2$ content of a hydrocarbon gas-$CO_2$ mixture to produce hydrocarbon gas having a sufficient BTU content for use as fuel. In another of its aspects this invention relates to a method for separating $CO_2$ and hydrocarbon gas from a mixture thereof. In yet another of its aspects this invention relates to the recovering of a $CO_2$ enriched product gas from a $CO_2$-hydrocarbon gas mixture.

Many natural gas wells produce a hydrocarbon gas that contains carbon dioxide. Improved oil recovery projects in which $CO_2$ is injected into a reservoir to displace oil produces a mixture of hydrocarbon gas and $CO_2$. There are, therefore, produced hydrocarbon gas streams containing $CO_2$ in amounts from traces up to about 98 percent of the total. While relatively small amounts of $CO_2$ in a hydrocarbon gas stream are not harmful, relatively large amounts of $CO_2$ sufficiently reduce the BTU content of the mixture so that it is not useful as a fuel gas.

It is therefore an object of this invention to provide a method for treating a mixture of hydrocarbon gas and carbon dioxide sufficiently to reduce the $CO_2$ content to provide a resulting mixture that is useful as a fuel. It is another object of this invention to provide a method for treating an underground reservoir using a mixture of hydrocarbon gas and carbon dioxide. It is still another object of this invention to provide a method for separating hydrocarbon gas from a mixture of hydrocarbon gas and carbon dioxide to produce a stream of increased carbon dioxide content.

Other aspects, objects and the various advantages of this invention will become apparent upon reading the specification and the appended claims.

Statement of the Invention

In accordance with this invention, a method is provided for treating an underground reservoir in the recovery of oil from the reservoir using a mixture of hydrocarbon gas and carbon dioxide in which a mixture of hydrocarbon gas and carbon dioxide is injected into at least one well in a oil containing underground reservoir thereby dissolving at least some carbon dioxide from the mixture into the oil; producing oil from at least one production well in the reservoir; and producing hydrocarbon gas having a carbon dioxide content less than that of the injected mixture of hydrocarbon gas and carbon dioxide from at least one production well other than the oil production well. This invention can be otherwise stated as a method for reducing the carbon dioxide content of a mixture of carbon dioxide and hydrocarbon gas by following the procedure just stated for injecting the mixture of hydrocarbon gas and carbon dioxide into an oil containing underground reservoir with the production of hydrocarbon gas with reduced carbon dioxide content from at least one well other than that used in producing oil from the reservoir.

In one embodiment of the invention a method is provided for periodically backflowing the well into which the mixture of hydrocarbon gas and carbon dioxide is injected to produce a mixture of hydrocarbon gas and carbon dioxide that is richer in carbon dioxide than the gas mixture originally injected.

The process of this invention depends on the dissolving of carbon dioxide from the mixture of hydrocarbon gas and carbon dioxide into the residual oil in the reservoir. The amount of carbon dioxide dissolved, because of relatively greater solubility in the crude oil, will be greater than the hydrocarbon gases absorbed (see Izvestiia, Akademiia nauk SSSR, Otdelenie Teknicheskikh, Nauk, No. 3, pp. 104–108 [1958] incorporated herein by reference). The solution of carbon dioxide in the residual oil results in an expansion of the volume of the residual oil so that drive of the oil from the injection well to the production well is facilitated. The swelling factor of the liquid in the reservoir expressed as volume of solution/volume of crude can range, depending upon the pressure maintained within the reservoir and the character of the crude in the reservoir, into the range of 1.2 or more. It can easily be seen that such an increase in the volume of the oil in the reservoir would increase the ease of forcing the oil through the reservoir toward a production well.

As an illustration of swelling factor, in a formation where the residual oil in place is 40 percent of the pore volume after initial production, a swelling factor of 10 percent would increase this oil by 4 percent pore volume ($40\% \times 0.10 = 4\%$) increasing the formerly 40 percent pore volume to 44 percent pore volume. The 4 percent pore volume now can be produced as it will become released during the swelling process. The swelling factor is directly related to density.

The process of this invention is carried out at pressures ranging from above atmospheric up to a pressure at which the $CO_2$ will miscibly displace oil. At a pseudo critical pressure of about 1100 psia the density of carbon dioxide approaches that of a liquid. A pressure above 1100 psia is therefore usually preferred for the operation of the invention.

During the treatment of the reservoir the hydrocarbon gas from which at least some of the carbon dioxide has been absorbed tends to collect in the upper permeable regions of the reservoir. This hydrocarbon gas depleted in carbon dioxide content can be collected from a production well other than the well used for producing oil. By monitoring the carbon dioxide content of the hydrocarbon gas a salable product can be produced as long as the carbon dioxide content is below that tolerable in salable hydrocarbon gas. Once the toleration limit is reached for carbon dioxide content the mixture of hydrocarbon gas and carbon dioxide can be collected from the reservoir and pumped to another reservoir containing oil using the method of this invention to again reduce the carbon dioxide content of the injected mixture to produce a salable hydrocarbon gas product.

It has also been found that by reducing the pressure at the injection well and backflowing reservoir material from the injection well a gas of higher carbon dioxide content than that originally injected can be produced. Upon reduction of pressure for backflowing, the carbon dioxide tends to come out of solution from the oil to produce a gas stream enriched in carbon dioxide.

This process for treating underground formations containing residual oil or for using underground formations containing residual oil to lower the carbon dioxide content of a mixture of hydrocarbon gas and $CO_2$ can be carried out in any underground formation containing residual liquid hydrocarbon. The method is, of course, most valuable in underground formations that have been greatly depleted of their liquid hydrocarbon stock. The process is compatible with water flooding techniques and with the various methods known for creating permanent and temporary blockages in the more permeable portions of underground formations such as by creating blockages with foams and gels.

The operation of the invention can be better understood by illustration with the following example. The example is meant to be illustrative only and should not be taken as restrictive.

EXAMPLE

The invention can best be illustrated by reference to Table I below which shows the effect of pressure on the solubility of $CO_2$ in oil at a fixed temperature and the resulting properties of the oil containing the $CO_2$.

TABLE I

PHYSICAL PROPERTIES OF $CO_2$ SATURATED CRUDE OIL FROM SMACKOVER CRUDE OIL AT 110° F

| $CO_2$ Pressure psia | $CO_2$ Content of Oil Wt. % | $CO_2$ Content of Oil Mole % | Viscosity, cp of Oil Rolling Ball | Viscosity, cp of Oil Capillary | Density of Oil g/cc | Swelling Factor Vol Sol/Vol Crude |
|---|---|---|---|---|---|---|
| Crude | — | — | 61.4 | 55 | 0.9150 | 1.00 |
| 150 | 1.6 | 12.2 | 58 | 42.5 | — | — |
| 250 | 2.7 | 19.3 | 43 | 36 | 0.923 | 1.019 |
| 350 | — | — | — | 30 | — | — |
| 440 | 5.05 | 31.7 | 25.5 | 24 | 0.925 | 1.041 |
| 880 | 11.1 | 51.9 | 11 | 12 | 0.922 | 1.116 |
| 1325 | 17.2 | 64.5 | 4.0 | 6.7 | 0.928 | 1.191 |

This table shows that as the pressure on the $CO_2$ increased, the amount of $CO_2$ dissolved in the oil increased at 110° F, the viscosity of the oil decreased appreciably and the swelling factor or swelling of the oil increased. The fact that the viscosity decreased enabled more oil to be produced because the oil flowed through the formation more readily.

Further analysis of the data shows that for Smackover crude with a pressure of 1325 psi, 17.2 weight percent of carbon dioxide dissolved in the oil at 110° F and 1325 psi. Stated another way, this means that there were 51 pounds of carbon dioxide dissolved in each barrel of oil, or 439 standard cubic feet of carbon dioxide dissolved in one barrel of oil when the oil was saturated with carbon dioxide. Another way of looking at this is that if there is 1 million barrels of residual oil in place, this amount of oil will dissolve at the pressure of 1325 psia and temperature of 110° F given in Table I, 439 million standard cubic feet of carbon dioxide.

In an actual operation in which natural gas having a 50 percent by weight of carbon dioxide is injected into a formation, the $CO_2$ will substantially all be absorbed into the oil until the oil becomes saturated with $CO_2$. During the production of gas while such injection is being carried out the initial gas produced will contain substantially no $CO_2$ since the $CO_2$ will be absorbed in the oil. As injection and production continue, and as the saturation point for $CO_2$ is approached, the produced gas will contain some $CO_2$. At the saturation point, all of the $CO_2$ injected with the injected natural gas will come out with the produced gas. It will then be necessary to open another, separate gas producing well in the field in an area where oil is present that is not saturated with dissolved $CO_2$. Injection of the natural gas containing $CO_2$ can be carried out until the oil becomes saturated with $CO_2$ between the injection well and new gas production well.

From the table above it can be seen that, as well as removing $CO_2$ from the injected natural gas, a large quantity of $CO_2$ will be taken up by the oil at the operating pressures and downhole temperature of the crude oil, which will enable more oil to be produced due to the decrease in viscosity of the oil.

I claim:

1. A method for treating an underground reservoir containing residual hydrocarbons using a mixture of hydrocarbon gas and carbon dioxide comprising:

a. injecting a hydrocarbon gas-carbon dioxide mixture into at least one well in an oil containing underground reservoir thereby dissolving at least some carbon dioxide into said oil;

b. producing oil from at least one production well in said reservoir other than the injection well; and c. producing hydrocarbon gas of carbon dioxide content lower than said injection mixture from at least one well in said reservoir other than said oil production and injection wells.

2. A method of claim 1 wherein upon reaching in the hydrocarbon gas produced from the reservoir the maximum carbon dioxide content tolerable in fuel gas (a) pressure is reduced at the injection well and (b) a backflow gas is produced at the injection well, said backflow having a higher $CO_2$ content than the gas that had been injected.

3. A method of claim 1 comprising periodically reducing the pressure of the injection well and backflowing a gas higher in $CO_2$ content than that originally injected.

4. A method of claim 3 wherein said backflow of gas is collected for use.

5. A method of claim 1 wherein the mixture of hydrocarbon gas and carbon dioxide injected into the reservoir was produced from carbon dioxide treatment of a reservoir system.

6. A method of claim 1 wherein said hydrocarbon gas containing carbon dioxide produced from the reservoir is collected for use.

7. A method for reducing carbon dioxide content of a mixture of carbon dioxide and hydrocarbon gas comprising:

a. injecting a hydrocarbon gas-carbon dioxide mixture into at least one well in an oil containing underground reservoir thereby dissolving at least some carbon dioxide into said oil;

b. producing oil from at least one production well in said reservoir other than the injection well; and c. producing hydrocarbon gas of carbon dioxide content lower than said injection mixture from at least one well in said reservoir other than said oil production and injection wells.

8. A method of claim 7 wherein upon reaching in the hydrocarbon gas produced from the reservoir the maximum carbon dioxide content tolerable in fuel gas (a) pressure is reduced at the injection well and (b) a backflow gas is produced at the injection well, said backflow gas having a higher $CO_2$ content than the gas that had been injected.

9. A method of claim 7 comprising periodically reducing the pressure of the injection well and backflowing a gas higher in $CO_2$ content than that originally injected.

10. A method of claim 9 wherein said backflow of gas is collected for use.

11. A method of claim 7 wherein the mixture of hydrocarbon gas and carbon dioxide injected into the reservoir was produced from carbon dioxide treatment of a reservoir system.

12. A method of claim 7 wherein said hydrocarbon gas containing carbon dioxide produced from the reservoir is collected for use.

* * * * *